US008083270B2

(12) United States Patent
Hwang

(10) Patent No.: US 8,083,270 B2
(45) Date of Patent: Dec. 27, 2011

(54) SAFETY HOOK STRUCTURE FOR HOOD

(75) Inventor: In Hwang, Gyeongsangbuk-do (KR)

(73) Assignee: Hyundai Motor Company, Seoul (KR)

( * ) Notice: Subject to any disclaimer, the term of this patent is extended or adjusted under 35 U.S.C. 154(b) by 436 days.

(21) Appl. No.: 12/275,149

(22) Filed: Nov. 20, 2008

(65) Prior Publication Data

US 2009/0250945 A1 Oct. 8, 2009

(30) Foreign Application Priority Data

Apr. 7, 2008 (KR) ..... 10-2008-0032160

(51) Int. Cl.
*E05C 19/10* (2006.01)
*E05C 19/00* (2006.01)

(52) U.S. Cl. .. 292/128; 292/108; 292/304; 292/DIG. 14

(58) Field of Classification Search ..... 292/95, 292/96, 99, 101–103, 108, 121, 122, 128, 292/194, 219, 229, DIG. 14, 85, 195, 198, 292/200, 304, DIG. 20, 1, 202–204, 210; 296/193.11; 180/69.2, 69.21
See application file for complete search history.

(56) References Cited

U.S. PATENT DOCUMENTS

| | | | | | |
|---|---|---|---|---|---|
| 1,100,953 | A | * | 6/1914 | Bujewski | 292/121 |
| 1,144,537 | A | * | 6/1915 | Gabriel | 292/128 |
| 1,885,713 | A | * | 11/1932 | Hammerly | 292/128 |
| 2,236,735 | A | * | 4/1941 | Saunders | 292/25 |
| 2,326,069 | A | * | 8/1943 | Samzelius | 292/128 |
| 2,877,035 | A | * | 3/1959 | Claud-Mantle | 292/56 |
| 2,894,379 | A | * | 7/1959 | Saunders | 62/377 |
| 3,049,371 | A | * | 8/1962 | Daly | 292/128 |
| 3,088,765 | A | * | 5/1963 | Krause | 292/11 |
| 3,966,244 | A | * | 6/1976 | Kleisser et al. | 292/127 |
| 4,236,853 | A | * | 12/1980 | Niggemeier et al. | 410/76 |
| 4,351,170 | A | * | 9/1982 | Clompus | 70/90 |
| 4,424,993 | A | * | 1/1984 | Shelby et al. | 292/128 |
| 5,046,768 | A | * | 9/1991 | Myslicki | 292/68 |
| 5,141,265 | A | * | 8/1992 | Claar et al. | 292/30 |
| 2006/0170224 | A1 | * | 8/2006 | Mitchell et al. | 292/216 |

FOREIGN PATENT DOCUMENTS

| | | |
|---|---|---|
| JP | H1-134169 | 9/1989 |
| KR | 20-0377616 | 3/2005 |

* cited by examiner

*Primary Examiner* — Carlos Lugo
*Assistant Examiner* — Alyson M Merlino
(74) *Attorney, Agent, or Firm* — Morgan, Lewis & Bockius LLP

(57) ABSTRACT

A safety hook structure for a hood is disclosed. The safety hook structure includes a bracket mounted on a rear surface of the hood and has a protrusion with a groove formed on the center thereof, a safety hook having a pivot portion pivotally inserted in the groove of the protrusion and moving in a horizontal direction, and a resilient member having one end fixed to the bracket and the other end fixed to the safety hook and applying a restoring force to the safety hook. Since the safety hook structure, which is moved in the horizontal direction to unlock the hood, is mounted on the hood, an enlarged buffer space for pedestrian protection is secured between an outer panel and an inner panel of the hood. Therefore, if a pedestrian is struck by an automobile, he/she can be protected by a stable buffer force. In addition, the safety hook structure can be easily manufactured by simplifying the construction of the safety hook, which can reduce the manufacturing cost thereof.

7 Claims, 6 Drawing Sheets

SAFETY HOOK STRUCTURE FOR HOOD

CROSS-REFERENCE TO RELATED APPLICATION

This application is based on and claims priority from Korean Patent Application No. 10-2008-0032160, filed on Apr. 7, 2008, in the Korean Intellectual Property Office, the disclosure of which is incorporated herein in its entirety by reference.

BACKGROUND OF THE INVENTION

1. Field of the Invention

The present invention relates to a safety hook structure for a hood, and more particularly, to a safety hook structure comprising an improved safety hook for locking the hood, which ensures an enlarged buffer space in the hood for the protection of a pedestrian struck by the hood.

2. Description of the Prior Art

Automobiles generally include a hood to protect the engine and to insulate sound generated by the engine.

The hood is hinge-engaged with a cowl top outer by a hinge, and is connected to a button or lever via a wire within an automobile. The hood is unlocked when the wire is pulled by manipulating the button or lever, which pulls the wire.

The locking structure of the hood includes a striker installed on a front end of the hood, which forms a locking hook, and also includes a latch installed on a radiator grill, which primarily locks the striker.

With the locking structure of the hood, the latch is operated by manipulating the button or lever installed in the automobile, which unlocks the striker.

In order to prevent the hood from lifting when the lever is manipulated by a careless driver, a safety hook structure is installed between the hood and the radiator grill to secondarily lock the hood.

The safety hook structure 30 includes, as shown in FIGS. 1 and 2, a bracket 31 mounted on the hood 10, a safety hook 32 pivotally coupled to the bracket 31 and having a knob 32*a* formed on an upper end thereof and a locking portion 32*b* formed on a lower end thereof and locked to locking hook 21 mounted on a radiator grill 20, a fixing member 33 penetrating a rotary axis of the safety hook 32 and fixed to the bracket 31 to support pivotally the safety hook 32, and a spring 34 engaged with the fixing member 33 for applying a restoring force to the safety hook 32.

Regarding the safety hook structure 30, if a driver puts his or her hand in the gap between the hood 10 and the radiator grill 20, and then the knob 32*a* of the safety hook 32 is pivoted upwards with respect to the fixing member 33, the locking portion 32*b* of the safety hook 32 is unlocked from the locking hook 21, and thus the driver can lift the hood 10.

Therefore, the latch and the safety hook structure prevent the hood from being abruptly opened, which significantly enhances the stability of the hood.

Meanwhile, the hood 10 is composed of an outer panel 11, which is for appearance purposes, and an inner panel 12, which is for protecting the engine. A buffer space for pedestrian protection is formed between the outer panel 11 and the inner panel 12. The buffer space for pedestrian protection absorbs the shock of a pedestrian when struck by an automobile.

Since a space for accommodating vertical pivot movement of the safety hook 32 pivotally rotating with respect to the fixing member 33 should be secured in the existing hood 10, as shown by the portion B in FIG. 1, the outer panel 11 and the inner panel 12 should be closely disposed. If such a space is secured in the existing hood 10, however, the buffer space for pedestrian protection is decreased, and thus a pedestrian is not sufficiently protected.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Accordingly, embodiments of the present invention has been made to solve the above-mentioned problems occurring in the prior art while the advantages achieved by the prior art are maintained.

One object of the present invention is to provide a safety hook structure for a hood having an improved safety hook for locking the hood, which ensures an enlarged buffer space for pedestrian protection between an outer panel and an inner panel of the hood.

Another object of the present invention is to provide a safety hook structure for a hood having an improved safety hook that can be easily manufactured by simplifying the construction of the safety hook.

In order to accomplish these objects, as an exemplary embodiment of the present invention, there is provided a safety hook structure for a hood which may comprise a bracket mounted on a rear surface of the hood and has a protrusion with a groove formed on the center thereof; a safety hook having a pivot portion pivotally inserted in the groove of the protrusion and rotatable in a horizontal direction; and a resilient member having one end fixed to the bracket and the other end fixed to the safety hook and applying a restoring force to the safety hook. The resilient member may be a torsion spring. The safety hook structure for a hood may further comprise a regulator member, formed on mating surfaces of the groove and of the pivot portion, adjusting a rotation angle of the safety hook wherein the regulator member includes an abutting portion formed on an outer periphery of the pivot portion, and a stepped portion formed on an inner wall of the groove and abutting against the abutting portion. The bracket and the safety hook may be provided with fixing members to fix both ends of the resilient member. The bracket and the safety hook may be provided with fixing members to fix both ends of the resilient member.

In another exemplary embodiment of the present invention, a safety hook structure for a hood may comprise: a bracket mounted on an inner panel of the hood and has a protrusion extending downwards from the inner panel with a groove formed on the center thereof; a safety hook having a pivot portion protruding upwards from a portion of the safety hook and pivotally inserted in the groove of the protrusion and movable in a horizontal direction with respect to the protrusion of the bracket; and a resilient member having one end coupled to the bracket and the other end coupled to the safety hook and applying a restoring force to the safety hook to bias the safety hook to an original position. The resilient member may be a torsion spring. The safety hook structure may further comprise a regulator member, formed on mating surfaces of the groove and of the pivot portion and adjusting a horizontal rotation angle of the safety hook; wherein the regulator member includes first and second abutting portions outward-protrusively formed on an inner rotation portion of the pivot portion, and first and second stepped portions inward-protrusively formed on an inner wall of the groove, the first substantially abutting portion abutting against the first stepped portion and the second abutting portion substantially abutting against the second stepped portion. An angle formed between the first abutting portion and the second abutting portion may be smaller than an angle formed between the first stepped portion and the second stepped portion. The bracket and the safety hook may be provided with fixing members and fix both ends of the resilient member. The resilient member may be a torsion spring. The bracket and the safety hook may be provided with fixing members to fix both ends of the resilient member.

In further another exemplary embodiment of the present invention, the regulator member may further comprise a buffer gap formed between an outer circumference of the pivot portion and an inner circumference of the protrusion and permits vertical rotation of the safety hook when the hood is moved downward so as to lock the hood to a locking hook. An angle formed between the first abutting portion and the second abutting portion may be smaller than an angle formed between the first stepped portion and the second stepped portion. The bracket and the safety hook may be provided with fixing members and fix both ends of the resilient member. The resilient member may be a torsion spring.

With the above construction, since the safety hook structure which is unlocked by horizontal pivot movement is mounted on the hood of an automobile, the buffer space for pedestrian protection is ensured between the outer panel and the inner panel of the hood. Also, manufacturing time and cost are remarkably reduced by simplifying the construction of the safety hook structure.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENTS

Figure 1:
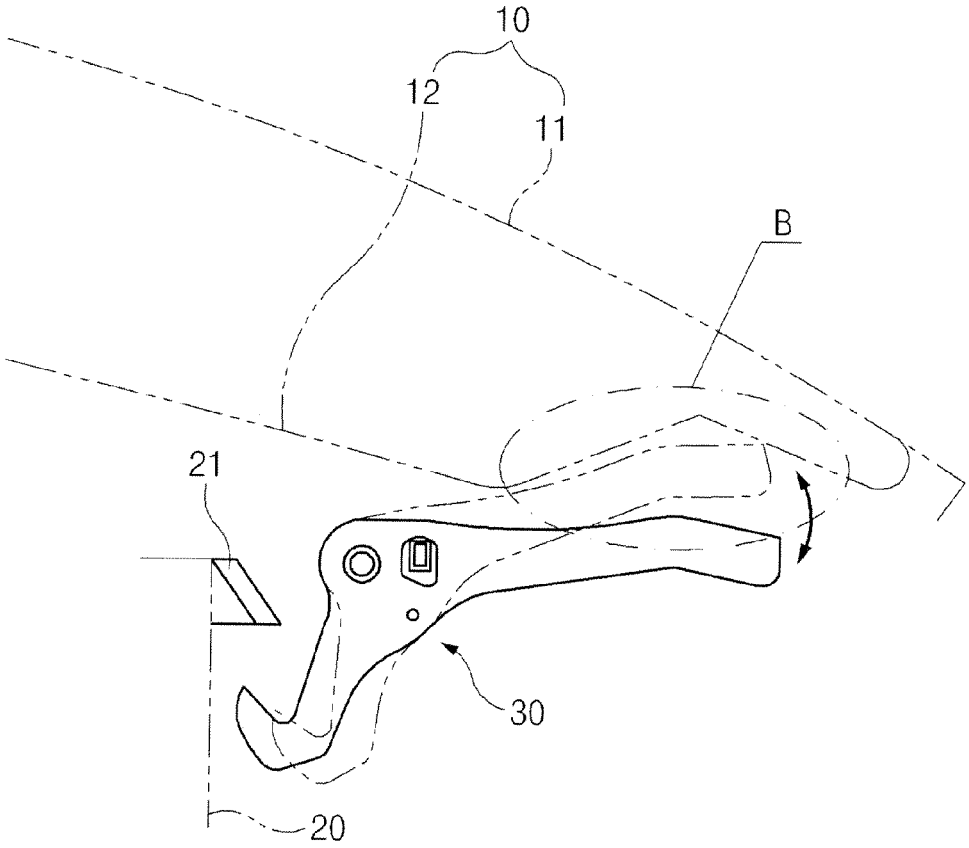
Fig.1 (Related Art)
FIG. 1 is a side view illustrating a conventional safety hook structure for a hood.
Figure 2:
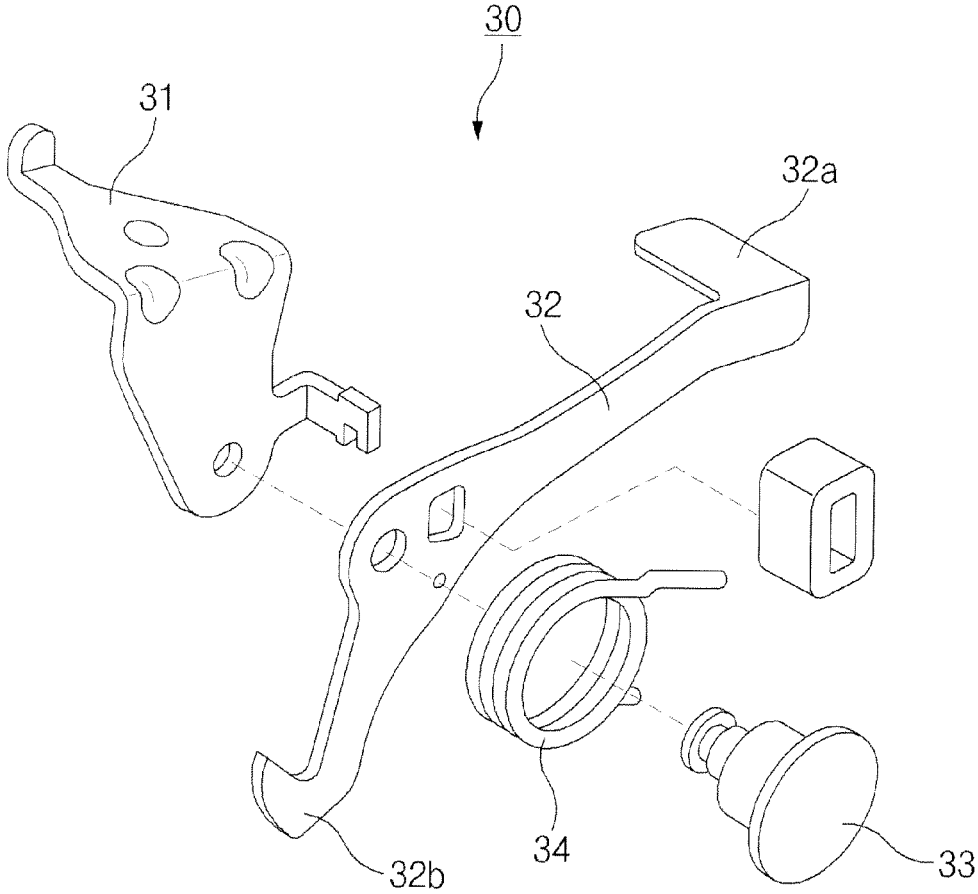
Fig.2 (Related Art)
FIG. 2 is an exploded perspective view illustrating a conventional safety hook structure for a hood.

Hereinafter, preferred embodiments of the present invention will be described with reference to the accompanying drawings. The matters defined in the description, such as the detailed construction and elements, are nothing but specific details provided to assist those of ordinary skill in the art for a comprehensive understanding of the invention, and thus the present invention is not limited thereto.

A safety hook structure for a hood according to an exemplary embodiment of the present invention will now be described in detail with reference to FIGS. 3 to 6.

In the entire description of the present invention, the same drawing reference numerals are used for the same elements across various figures, and the detailed description thereof will be omitted.

Figure 3:
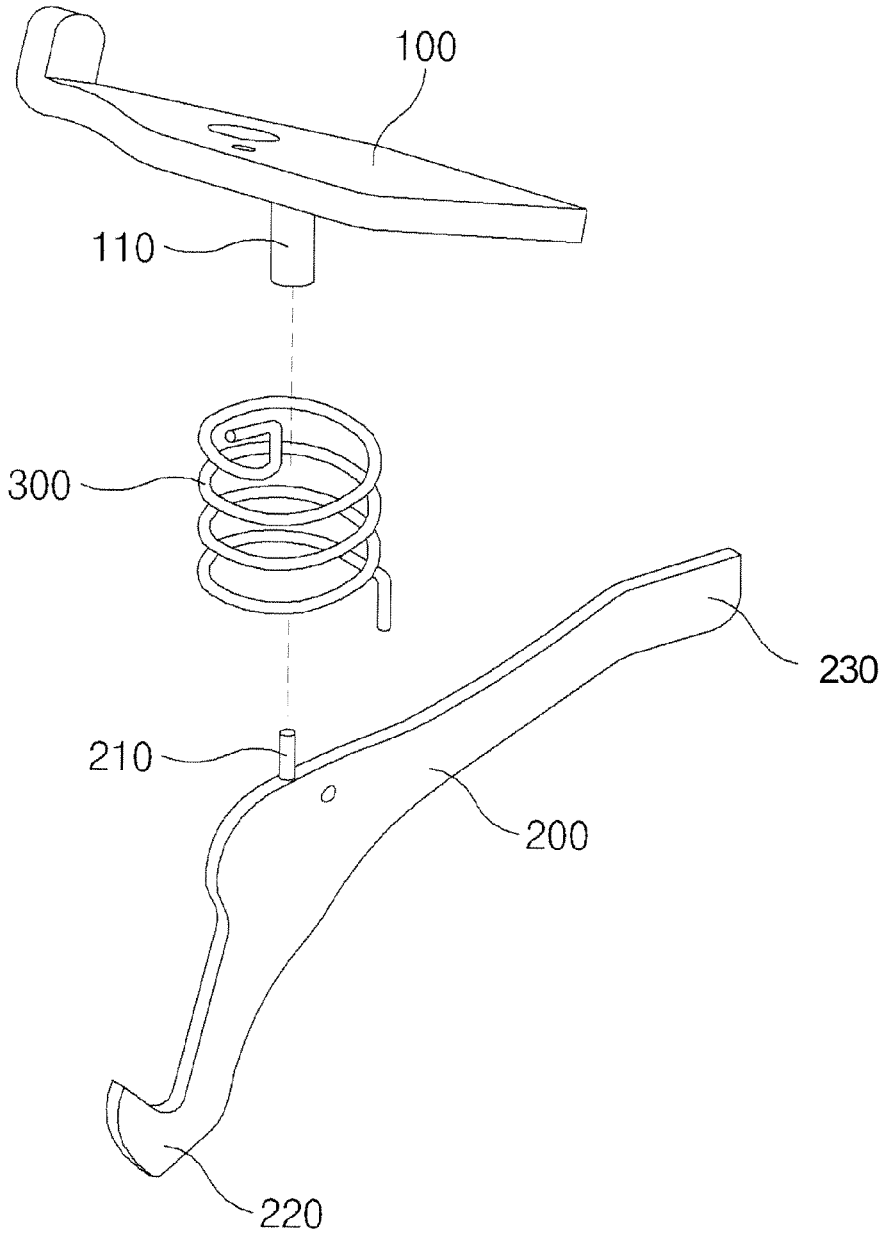
FIG. 3 is a perspective view illustrating a safety hook structure for a hood according to the an exemplary embodiment of present invention.
Figure 4:
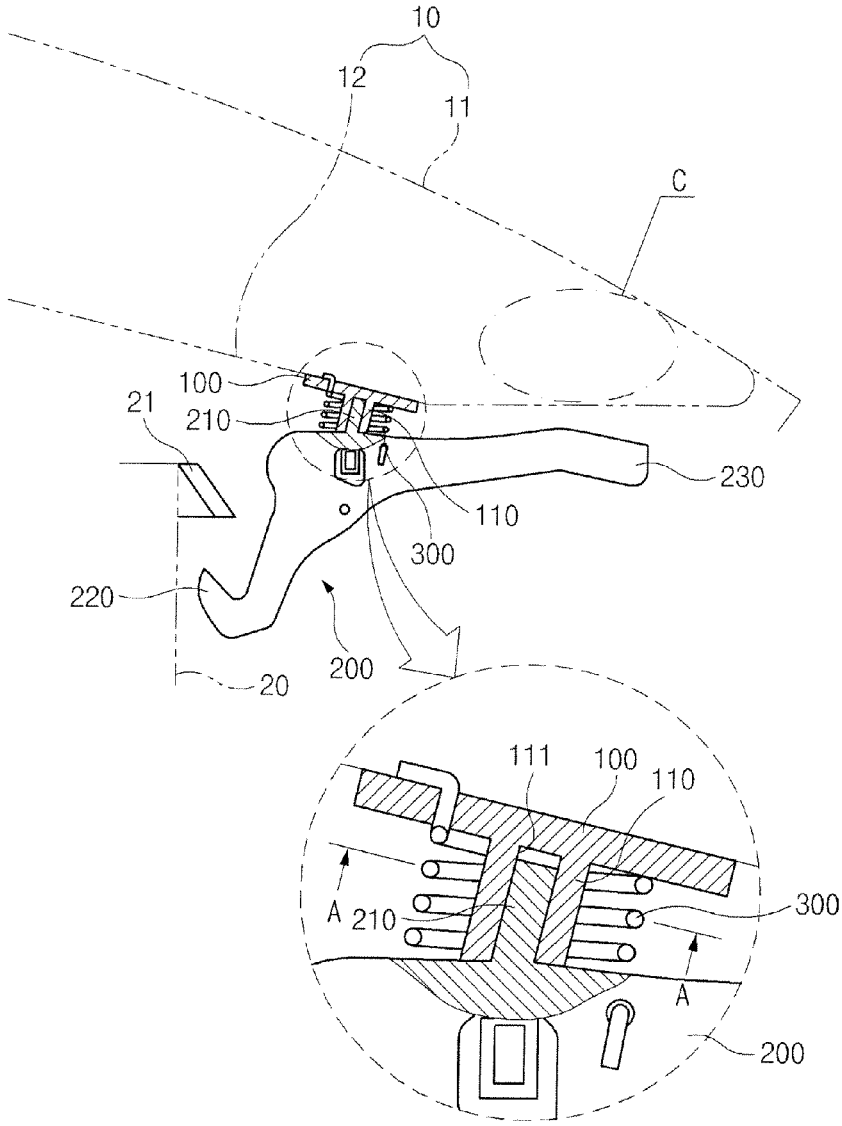
FIG. 4 is a cross-sectional view of the safety hook structure in FIG. 3.

The safety hook structure for the hood according to an exemplary embodiment of the present invention includes, as shown in FIGS. 3 and 4, a bracket 100 mounted on inner panel 12 of a hood 10, a safety hook 200 pivotally coupled to the bracket 100 to lock or unlock the hood 10 and rotatable in a horizontal direction thereof, and a resilient member 300 to apply a restoring force to the safety hook 200.

The bracket 100 is for pivotally coupling the safety hook 200 to the hood 10, and is mounted on the inner panel 12 of the hood 10 by means of a number of fastening members. The bracket 100 is provided on a bottom surface thereof with a protrusion 110 extending downwards and having a receiving groove 111 therein.

The safety hook 200 is for locking or unlocking the hood 10, and has a pivot portion 210 protruding upwards from an upper portion of the safety hook 200 and pivotally inserted in the receiving groove 111 of the protrusion 110 and rotatable in a horizontal direction with respect to the center axis of the protrusion 10, a locking portion 220 formed on a front end of the safety hook 200 and locked by a locking hook 21 mounted on a radiator grill 20, and a knob 230 formed on one rear end of the safety hook 200 for pivoting the safety hook 200.

With the safety hook 20, if a driver pivots the knob 230 in a horizontal direction with respect to the protrusion 10 by his or her finger, the locking portion 220 pivots around the pivot portion 210 inserted in the receiving groove 111 of the protrusion 10, and thus the locking portion 220 is unlocked and released from the locking hook 21.

A regulator member for adjusting a horizontal rotation angle of the safety hook 200 is formed on mating surfaces of the receiving groove 111 of the protrusion 110, and of the pivot portion 210.

Figure 5:
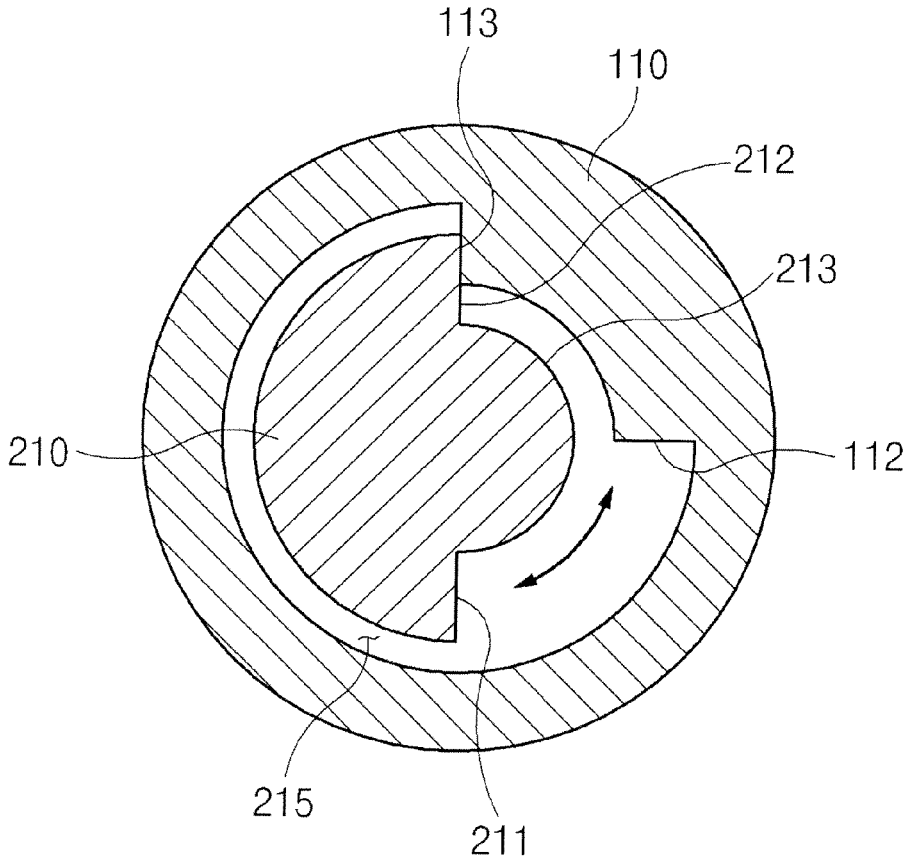
FIG. 5 is a cross-sectional view taken along line A-A in FIG. 4.

The regulator member includes, as shown in FIG. 5, an inner rotation portion 213, having a predetermined diameter, first and second abutting portions 211 and 212 outward-protrusively formed from an outer periphery of the inner rotation portion 213, and first and second stepped portions 112 and 113 protruding inwardly from an inner wall of the receiving groove 111, wherein the first abutting portion 211 abuts against the first stepped portion 112 and the second abutting portion 212 abuts against the second stepped portion 113 to regulate a pivot angle of the pivot portion 210 in the horizontal direction. The angle formed between the first abutting portion 211 and the second abutting portion 212 is smaller than the angle formed between the first stepped portion 112 and the second stepped portion 113.

More specifically, when the pivot portion 210 pivots around the receiving groove 111, the first abutting portion 211 formed on the pivot portion 210 abuts against the first stepped portion 112 or the second abutting portion 212 formed on the pivot portion 210 abuts against the second stepped portion 113 according to the rotation direction of the safety hook 200 to regulate the pivot angle of the pivot portion 210 in the horizontal direction.

In an exemplary embodiment of the present invention, a buffer gap 215 may be formed between the pivot portion 210 and the protrusion 110. Accordingly, when the hood 10 is moved downwards to be locked, the locking portion 220 of the safety hook 200 strikes the locking portion 21 but the buffer gap 215 permits the safety hook 200 to pivotally rotate in the vertical direction with small vertical displacement without breaking the safety hook 200 due to the marginal gap (i.e., the buffer gap 215) formed between the pivot portion 210 and the protrusion 110.

A fixing member (not shown) may be provided between the protrusion 110 and the pivot portion 210 so that the pivot portion 210 does not slide out of the receiving groove 111.

As a result, the safety hook 200 is pivoted around the bracket 100 in a horizontal direction, thereby reducing the rotation space (See portion B in FIG. 1) required for vertical pivot movement of the safety hook 32. Therefore, a large buffer space (See portion C in FIG. 4) for pedestrian protection is secured between the outer panel 11 and the inner panel 12 of the hood 10.

The resilient member 300 is for applying the restoring force to the safety hook 200 so that the safety hook 200 is restored to the original position. The resilient member 300 is positioned between the bracket 100 and the safety hook 200 in such a manner to enclose the protrusion 110 and the pivot portion 210. In an exemplary embodiment, the resilient member 300 has an upper end penetrating the bracket 100 and is fixed by bending the penetrated end, and a lower end penetrating a vertical surface of the safety hook 200 and is fixed by bending the penetrated end.

The resilient member 300 applies the restoring force to the safety hook 200 so that the locking portion 220 of the safety hook 200 is restored to the state in which the locking portion 220 is locked by the locking hook 21. Preferably, a torsion spring is used as the resilient member 300.

The operation of the safety hook structure for the hood according to an exemplary embodiment of the present invention will now be described.

First, when the hood 10 is unlocked by using a hood latch (not shown) mounted on an automobile, the hood 10 is lifted by to predetermined height, and simultaneously, is again locked by the locking portion 220 of the safety hook 200.

In this instance, if a driver puts his or her hand in a gap between the hood 10 and the radiator grill 20, and then the knob 230 of the safety hook 200 is pivoted in a horizontal direction, the safety hook 200 pivots around the protrusion 10 of the bracket 100 in the horizontal direction. As a result, the locking portion 220 of the safety hook 200 is unlocked from the locking hook 21, so that the driver can lift the hood 10.

In this instance, the resilient member 300 stores the torsion restoring force generated as the safety hook 200 pivots in the horizontal direction.

When the external force pivoting the safety hook 200 is released, the safety hook 200 is returned to the original position by the restoring force of the resilient member 300. In this instance, if the hood 10 is moved downward, the locking portion 220 of the safety hook 200 is again locked by the locking hook 21 since due to the buffer gap 215 formed between the pivot portion 210 and the protrusion 110, the safety hook 200 pivotally rotate in the vertical direction with small vertical displacement but is not broken when the locking portion 220 of the safety hook 200 strikes the locking portion 21 downwards.

Figure 6:
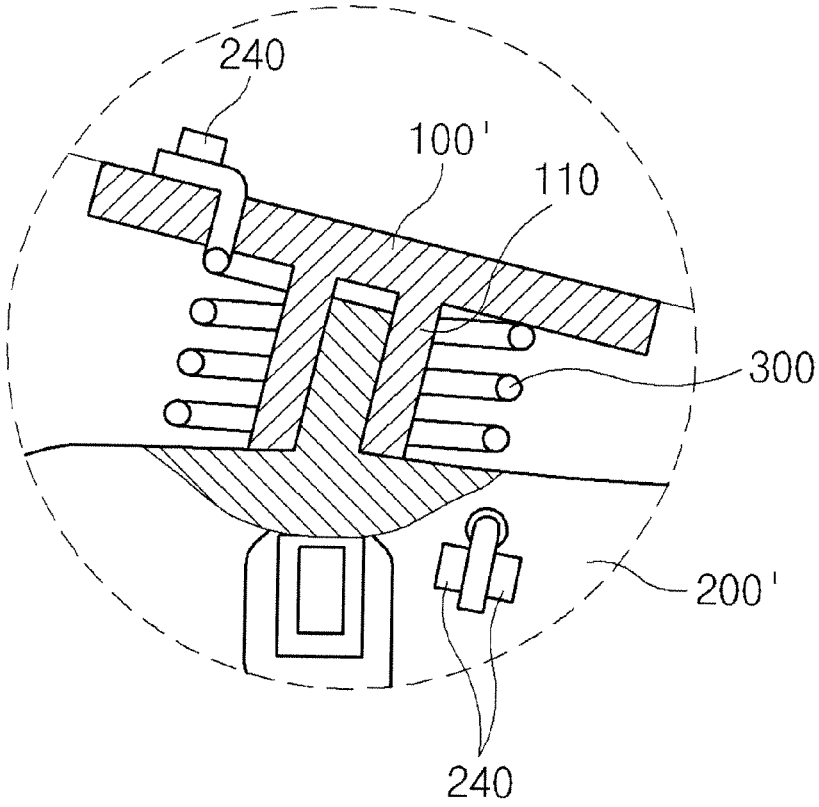
FIG. 6 is a cross-sectional view illustrating a safety hook structure for a hood according to an alternative exemplary embodiment of the present invention.

A safety hook structure for a hood according to an alternative embodiment of the present invention will now be described, in which the same drawing reference numerals are used for the same elements across various figures, and the detailed description thereof will be omitted FIG. 6 is a view illustrating a safety hook structure for a hood according to an alternative exemplary embodiment of the present invention.

The safety hook structure includes, as shown in FIG. 6, fixing members 240 positioned on surfaces of a bracket 100' and a safety hook 200', on which both ends of a resilient member 300 are locked and supported.

More specifically, the fixing members 240 support both ends of the resilient member 300, which guides the stable rotation force of the safety hook 200.

Although preferred embodiments of the present invention have been described for illustrative purposes, those skilled in the art will appreciate the various modifications, and the possibility of additions and substitutions, without departure from the scope and spirit of the invention as disclosed in the accompanying claims.

What is claimed is:

1. A safety hook structure for a hood comprising:

a bracket mounted on an inner panel of the hood and has a protrusion extending downwards from the inner panel with a groove formed on the center thereof;

a safety hook having a pivot portion protruding upwards from a portion of the safety hook and pivotally inserted in the groove of the protrusion and movable in a horizontal direction with respect to the protrusion of the bracket;

a resilient member having one end coupled to the bracket and the other end coupled to the safety hook and applying a restoring force to the safety hook to bias the safety hook to an original position; and a regulator assembly, formed on mating surfaces of the groove and of the pivot portion and adjusting a horizontal rotation angle of the safety hook;

wherein the regulator assembly includes first and second abutting portions outward-protrusively formed on an inner rotation portion of the pivot portion, and first and second stepped portions inward-protrusively formed on an inner wall of the groove, the first substantially abutting portion abutting against the first stepped portion and the second abutting portion substantially abutting against the second stepped portion; and wherein the regulator assembly further comprises a buffer gap formed between an outer circumference of the pivot portion and an inner circumference of the protrusion and permits vertical rotation of the safety hook with respect to a horizontal rotational axis of the safety hook when the hood is moved downward so as to lock the hood to a locking hook.

2. The safety hook structure as claimed in claim 1, wherein an angle formed between the first abutting portion and the second abutting portion is smaller than an angle formed between the first stepped portion and the second stepped portion.

3. The safety hook structure as claimed in claim 2, wherein the bracket and the safety hook are provided with fixing members that respectively fix each end of the resilient member to the bracket and the safety hook.

4. The safety hook structure as claimed in claim 3, wherein the resilient member is a torsion spring.

5. The safety hook structure as claimed in claim 1, wherein the resilient member is a torsion spring.

6. The safety hook structure as claimed in claim 1, wherein the bracket and the safety hook are provided with fixing members that respectively fix each end of the resilient member to the bracket and the safety hook.

7. The safety hook structure as claimed in claim 6, wherein the resilient member is a torsion spring.

* * * * *